United States Patent [19]

Pellegrineschi

[11] Patent Number: 5,075,649

[45] Date of Patent: Dec. 24, 1991

[54] ADAPTIVE PHASE AND AMPLITUDE DISTRIBUTOR

[75] Inventor: Giovanni Pellegrineschi, Rome, Italy

[73] Assignee: Selenia Spazio S.p.A., L'Aquila, Italy

[21] Appl. No.: 480,095

[22] Filed: Feb. 14, 1990

[30] Foreign Application Priority Data

Feb. 14, 1989 [IT] Italy ..... 47647 A/89

[51] Int. Cl.[5] ..... H01P 5/12

[52] U.S. Cl. ..... 333/137; 333/21 A; 342/361

[58] Field of Search ..... 333/125, 137, 21 A; 342/361

[56] References Cited

U.S. PATENT DOCUMENTS

| | | | |
|---|---|---|---|
| 2,713,151 | 7/1955 | Farr | 333/137 |
| 3,588,751 | 6/1971 | Paine | 333/137 |
| 4,310,813 | 1/1982 | Yuuki et al. | 333/21 A X |
| 4,492,938 | 1/1985 | Young | 333/137 X |
| 4,797,681 | 1/1989 | Kaplan et al. | 333/137 X |

*Primary Examiner*—Paul Gensler

*Attorney, Agent, or Firm*—Cohen, Pontani & Lieberman

[57] ABSTRACT

Adaptive phase and amplitude distributor for use with satellite antennae which require distribution of transmitter-generated microwave power over many elementary radiators having predetermined amplitude and phase characteristics thus achieving required radiation patterns. It consists essentially of two polarizers three circular waveguide rotating joints, all interconnected in a joint-to-polarizer-to-joint-to-polarizer-to-joint relation and followed by an orthomode TM transducer output which serves to separate the orthogonal components of the electromagnetic field. By rotating the two polarizers around the waveguide axis independently and by suitable choice of the rotating angles, it is possible to distribute the power entering at one port, say in the $TE_{11}$ mode, on the two orthogonal components, still in $TE_{11}$, with any amplitude and phase relationship at the output. The two components are separated by the orthomode TM transducer. The invention belongs to the microwaves field and more specifically to that of TLC satellites.

5 Claims, 4 Drawing Sheets

ADAPTIVE PHASE AND AMPLITUDE DISTRIBUTOR

BACKGROUND AND SUMMARY OF THE INVENTION

This invention relates to an adaptive phase and amplitude distributor which is based on circular W/G polarizers and rotating joints interconnected according to a joint-polarizer-joint-polarizer etc. configuration and on an orthomode TM transducer placed at the output to separate the orthogonal components of the electromagnetic field.

The invention belongs to the microwave field. It finds a most advantageous application within an antenna system, preferably satellite borne, where the transmitter power needs to be distributed over many elementary radiators having pre-determined amplitude and phase to acheive desired radiation patterns.

This distributor derives from an existing system, simplified and adapted, originally conceived for different purposes, known as "soft fail" and used successfully for quite some time by the owner of the Italian patent No. 1 149 024.

The existing soft fail solution, from which the distributor here presented derives, combined the power of two transmitters (350 W nom each at 18 GHz) adaptively to deliver it to an antenna without losses. If the power and phase ratio of the two transmitters vary, the soft fail device would adapt to the situation arising so that the sum of the two transmitters power would continue to feed the antenna and not the "dummy load", as would have happened by adopting a non adaptive combiner (FIG. 4).

The device which is presented hereby, and which we shall refer to as APAD (Adaptive Phase and Amplitude Distributor) works, in principle, in an opposite manner; it takes the power from one single source and it distributes it with presettable amplitude and phase to two loads, such as two foods.

If the soft fail works, according to the reciprocity principle, it must also operate as a combiner; moreover the circuit may be simplified because one of the two OMTs may be eliminated (FIG. 1). Losses, which were already low in the soft fail, are here almost halved.

In general, when the radiation pattern of satellite borne antennae needs to be reconfigured, an array of small feeds is placed on the local plane of a reflector antenna. By exciting such feeds in phase and amplitude, different radiation patterns of the antenna can be obtained.

The APAD is a device based on two rotating joints and polarizers, which distributes the power produced by a microwave source between two separate loads with any phase and amplitude relationship and low losses.

The distribution ratio is a function of the rotating angle of the polarizers, which are therefore the controlling variables.

By utilizing more than one identical independently controlled device, a transmitter power distribution network for a feed array can be obtained with any variable amplitude and phase pattern.

Until now similar but bulkier devices were available. The prior devices, affected by greater losses, were based upon a double rotating joint which could phase-shift the signal of one path against the other by 180° and were further based on an additional phase shifter having a different structure. The greater losses were due to the phase shifter.

As we have said, the APAD may be compared to the previous soft fail 180° polarizer, but cut into half lengthwise and modified to become two 90° polarizers.

In this manner the two sections of the 180° polarizer once made independent, perform the same function as the non-sectioned polarizer joined to the phase shifter.

Furthermore, this device suffers lower losses by virtue of the fact that it makes use of one single OMT (Orthomode TM Transducer) in its original configuration.

The elimination of the phase shifter also results in a weight reduction.

BRIEF DESCRIPTION OF THE DRAWING

The invention will now be described for illustrative, non limiting purposes with reference to the Figures attached.

DETAILED DESCRIPTION OF THE PREFERRED EMBODIMENTS

Figure 1:
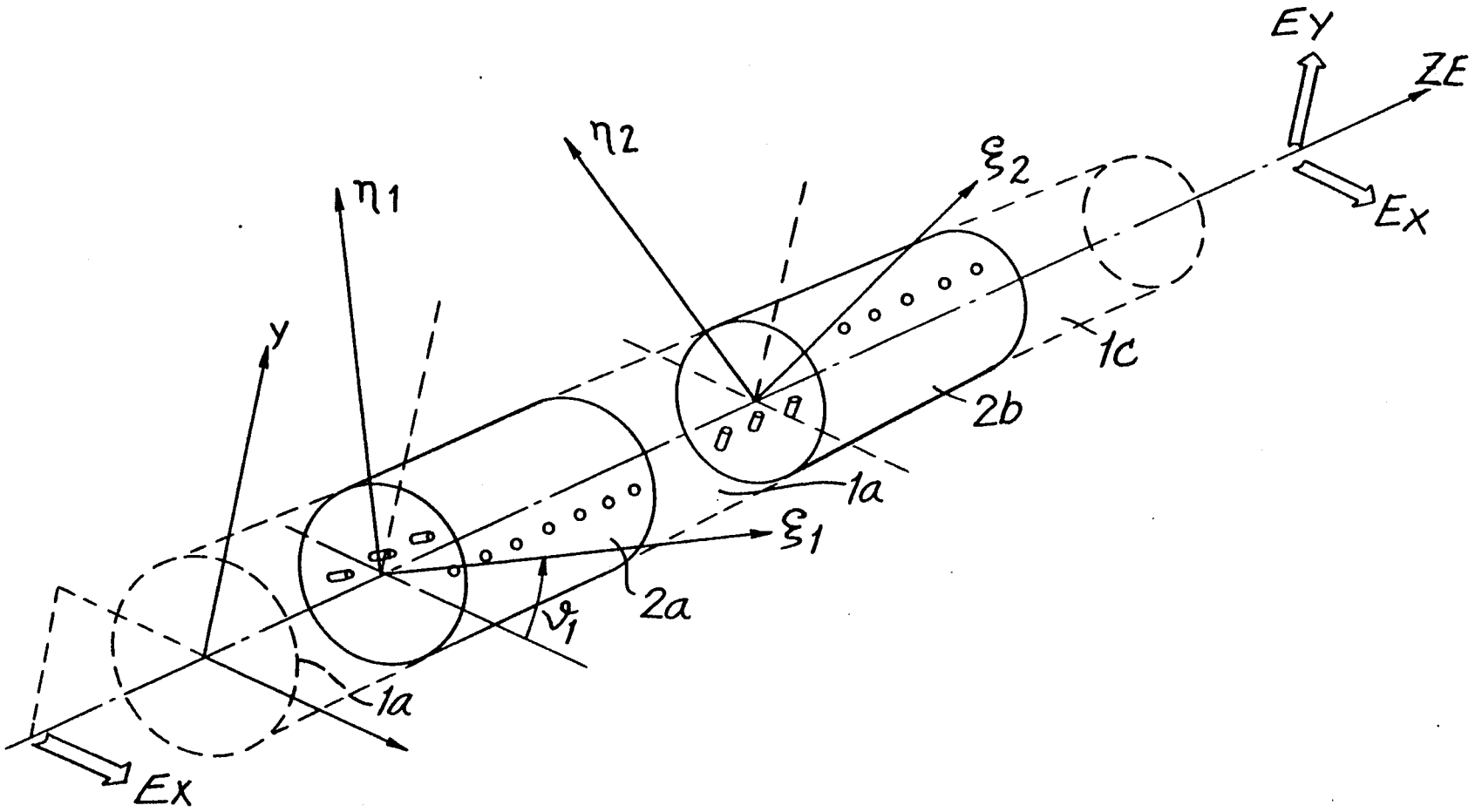
FIG. 1 shows an operational drawing of the adaptive phase and amplitude distributor where: 1*a*, 1*b*, 1*c* show the position of the rotating joints; 2*a*, 2*b* show the circular waveguide polarizers with the same diameter as the joints above.

As anticipated, FIG. 1 shows circular W/G polarizers 2*a*, 2*b* connected to, a same diameter W/G by means of rotating joints, of which positions 1*a*, 1*b* and 1*c* are shown.

Figure 1A:
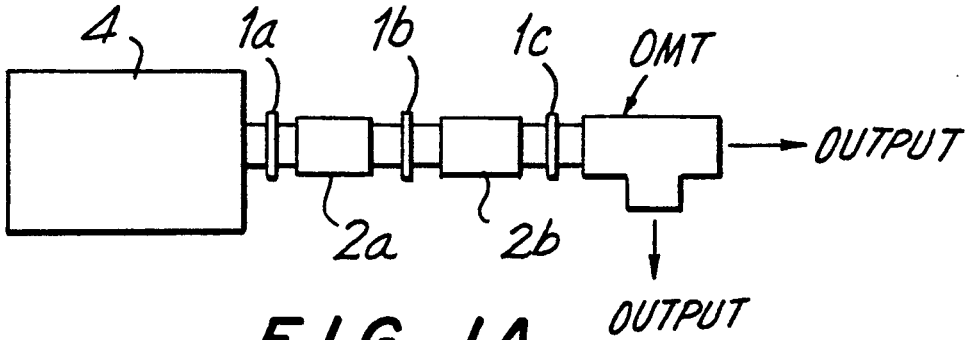
FIG. 1*a* shows a diagrammatic representation of the device illustrated in FIG. 1, including the microwave transmitter.

FIG. 1*a* depicts a device constructed in accordance with the present invention, particularly showing the functional interconnection of the output of a transmitter 4 to polarizers 2*a* and 2*b*, linked by rotary joints 1*a*,1*b* and 1*c*, and the two output signals which are available at the two output ports of the OMT.

The general reference system is identified as X, Y, Z where the Z axis coincides with the W/G and with the joint rotation axes (FIG. 1).

Each polarizer has its own reference system.

Let $\xi_1$, $\eta_1$, $\zeta_1$, and $\xi_2$, $\eta_2$, $\zeta_2$ be the references of polarizers 2*a* and 2*b*. Axes $\zeta_1$, $\zeta_2$ are oriented as z, while axes $\xi_1$, $\eta_1$ and $\xi_2$, $\eta_2$ are rotated with respect to x and y by angles $\theta_1$ and $\theta_2$. Axes $\xi_1$ and $\xi_2$ lie in the delay elements planes of each related polarizer.

The electromagnetic field can propagate in two W/G in mode $TE_{11}$, which may be oriented according to two orthogonal directions, such as x and y or $\xi$ and $\eta$. In other words, the electromagnetic field which can propagate in the W/G may always be split into two orthogonal components.

The $\xi$ axis component is delayed within each polarizer by 90° behind the component oriented along the $\eta$ axis. A $TE_{11}$ mode E.M. field oriented according to the x axis (electric field) is applied to the input.

Due to the different interaction of the field components with the polarizer structure, the output will provide both x and y components with an amplitude and phase ratio which is a function of rotation angles $\theta_1$ and $\theta_2$.

Figure 2:
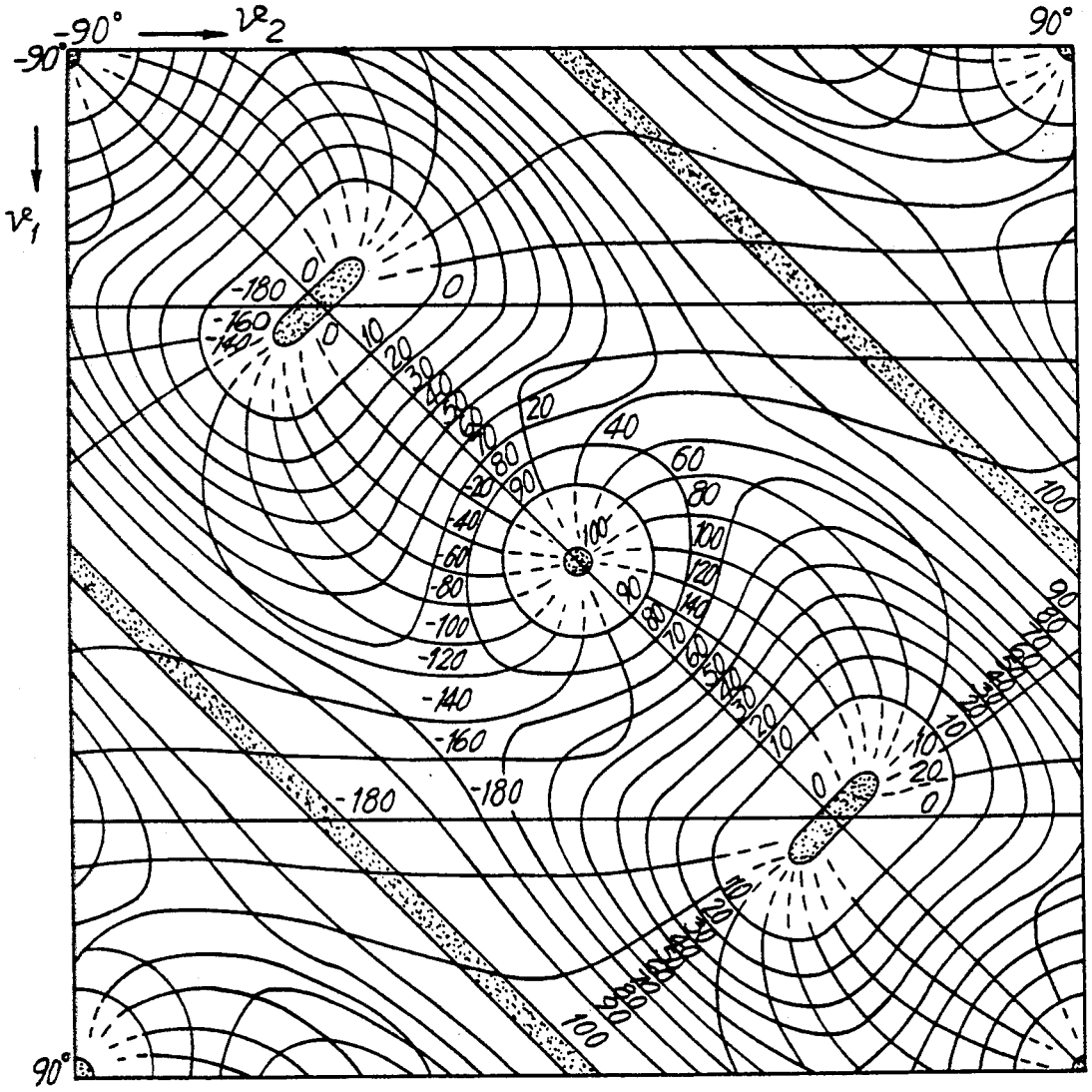
FIG. 2 shows the operating characteristics of the amplitude distributor, and, in particular the relationship between rotation angles $\theta_1$ and $\theta_2$ and power distribution percent and the phase relationship between $TE_{11}$ modes oriented along x and y axis of the APAD device (shown in FIG. 1).

By carrying out all calculations, it is found that the phase and amplitude relation (equal to the ratio of squared amplitudes) is that shown in the diagram of FIG. 2.

The lines labled as 0, 10, 20, 30 . . . 100 show the loci on plane $\theta_1$, $\theta_2$ corresponding to an E.M. field output power oriented according to the x axis equal to 0%, 10%, 20% . . . 100% of the total (and therefore the complement to 100 is the power output with a field oriented along the y axis).

Lines labled −180, −160 . . . 0, 160, 180 show the loci on plane $\theta_1$, $\theta_2$ which correspond to a phase difference between x and y components equal to −180°, −160°, 0, 160°, 180° respectively.

As each possible choice of the amplitude (power) and phase ratio identifies at least one point of the diagram (i.e. a pair of $\theta_1$, $\theta_2$ values), it means that the device, rotated by angles $\theta_1$, $\theta_2$, distributes power and phase between output components x and y in the selected mode.

Pick-up of the two x and y power components may be made by means of an Orthomode TM transducer (OMT), a standard W/G component.

Figure 3:
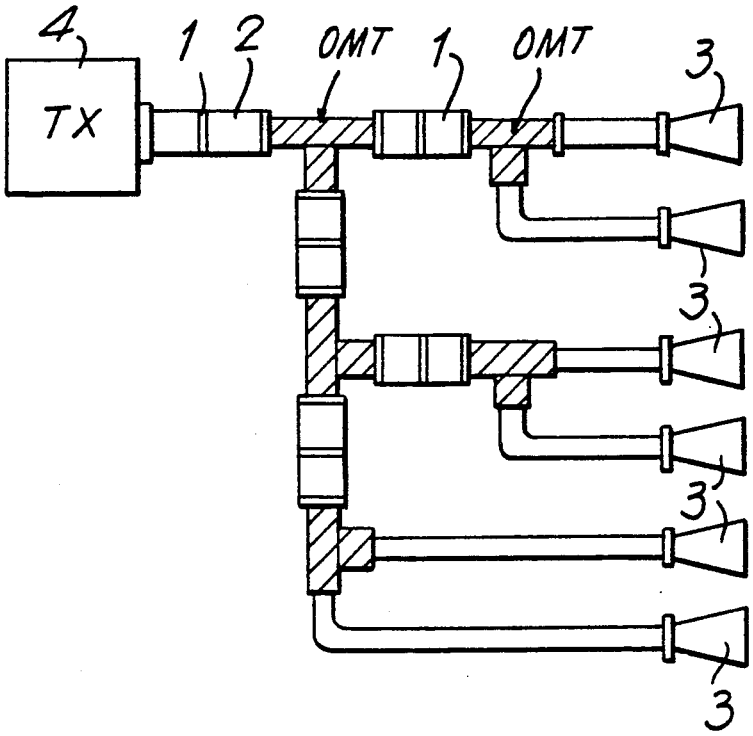
FIG. 3 is an example of utilization of more than one distributor to feed a chain of any number of antenna feeds.

By inserting more than one device into a suitable distribution network such as that shown in FIG. 3, it is possible to share the transmitter power among any number of end users with any preestablished amplitude and phase characteristics. The amplitude and phase distributors are shown, where 1 stands for the rotating joint and 2 for the polarizer, respectively. Transmitter 4 and feeds 3 are also visible.

Figure 5:
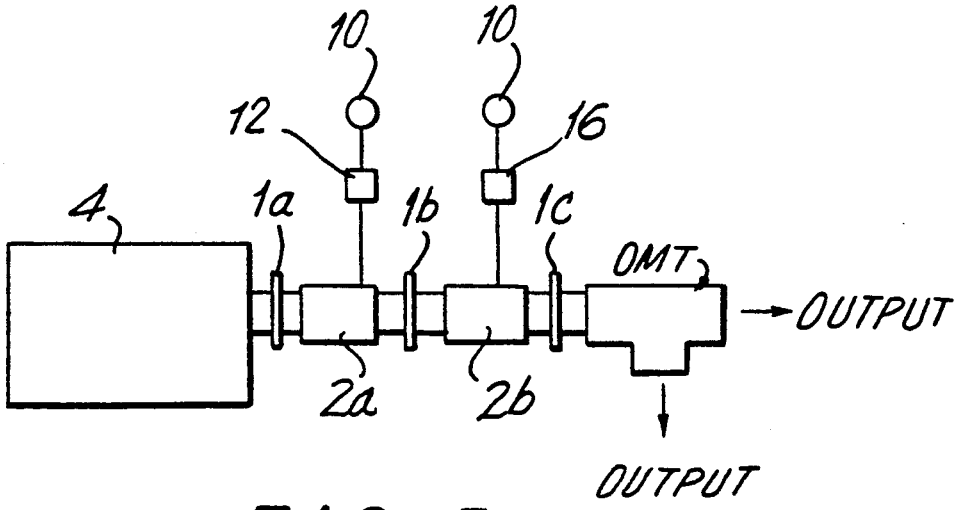
FIG. 5 shows an additional embodiment utilizing automatic control means to adjust the rotary polarizers.

By providing each polarizer with a motor 10,14 and angle sensor 12,16, as shown in FIG. 5 power and phase distribution may be set remotely on a feed array placed on the focal plane of an antenna and consequently the antenna radiation beam pattern may be varied within wide limits.

The device may also be built by means of polarizers having a phase delay other than 90°. In such case, the diagram in FIG. 2 is different; the angle control system may easily take this into account.

An essential feature of the device is to obtain power distribution by means of two orthogonal W/G propagation modes and obtaining the variation of their excitation by means of the rotation of the two devices around the propagation axis.

It is therefore possible to obtain the same operation by adopting propagation modes other than $TE_{11}$ and/or waveguides other than circular once the mechanical rotation problem is solved.

Finally, the adaptive phase and amplitude distributor called APAD, may be considered a key element in the preparation of re-configurable devices already known in the technical world as beam forming network.

Figure 4:
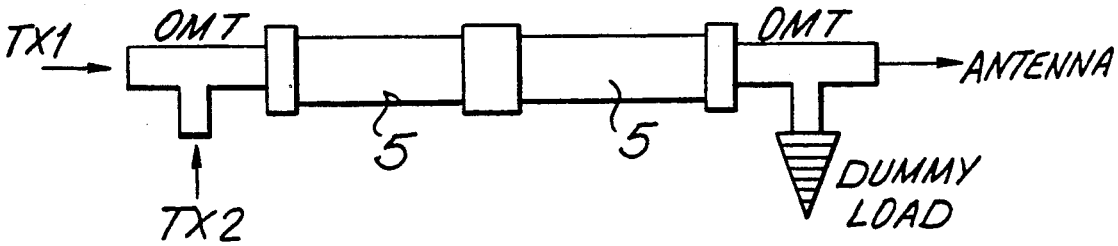
FIG. 4 is an example of a previous solution.

FIG. 4 shows a previous solution where polarizer 5 can be seen.

It should be understood that the preferred embodiments and examples described are for illustrative purposes only and are not to be construed as limiting the scope of the present invention which is properly delineated only in the appended claims.

I claim:

1. Apparatus for adaptively distributing microwave signals of varying amplitude and phase to the feed elements of an antenna for transmission of said signals by the antenna, said apparatus comprising;

means for generating a microwave signal for transmission of the microwave signal by an antenna;

a first, a second and a third rotary waveguide joint, each having an input end and an output end;

said first rotary waveguide joint input end being operatively connected to said microwave signal generating means for receiving the microwave signal from said generating means;

a first means for polarizing a microwave signal, said first polarizing means being connected to said first rotary waveguide joint output end and to said second rotary waveguide joint input end for variable rotary positioning of said first polarizing means, said first polarizing means being positionally rotatable for selectively varying the polarization of the microwave signal from said first rotary waveguide joint output end in conformance with the rotary position of said first polarizing means and outputting a varied polarized microwave signal to said second rotary waveguide joint input end;

a second means for polarizing a microwave signal, said second polarizing means being connected to said second rotary waveguide joint output end and to said third rotary waveguide joint input end for variable rotary positioning of said second polarizing means, said second polarizing means being positionally rotatable for selectively varying the polarization of said varied polarized microwave signal from said second rotary waveguide joint output end in conformance with the rotary position of said second polarizing means and outputting a further varied polarized microwave signal to said third rotary waveguide joint input end, said further varied polarized microwave signal comprising two separate microwave signal components, each of said separate microwave signal components having an amplitude and a phase; and an Orthomode transducer for separating said two separate microwave signal components into two discrete microwave signals, said transducer having an input port operatively connected to said third rotary waveguide joint output end for receiving said further varied microwave signal, and said transducer having two output ports, each of said two output ports outputting one of said discrete microwave signals to an antenna feed and each said discrete microwave signal having an amplitude and a phase.

2. The apparatus according to claim 1, wherein each of said first and said second polarizing means comprises a 90 degree circular waveguide polarizer.

3. The apparatus according to claim 1, wherein each of said first and said second waveguide polarizers and said first, second and third rotary waveguide joints have a substantially equal inner diameters.

4. The apparatus according to claim 2, wherein each of said first and said second waveguide polarizers and said first, second and third rotary waveguide joints have a substantially equal inner diameter.

5. The apparatus according to claim 1, further comprising:

means for sensing the rotary position of said first polarizing means;

means for rotating said first polarizing means, said first polarizer rotating means being responsive to said first polarizer position detecting means for selective rotary adjustment of said first polarizer rotary position;

means for sensing the rotary position of said second polarizing means; and means for rotating said second polarizing means, said second polarizer rotating means being responsive to said second polarizer position detecting means for selective rotary adjustment of said second polarizer rotary position.

* * * * *